United States Patent [19]
Olivares
[11] 4,317,543
[45] Mar. 2, 1982

[54] PROCESS FOR SEPARATING COPPER AND IRON MINERALS FROM MOLYBDENITE

[76] Inventor: Juan P. Olivares, P.O. Box 20, Nacozari, Sonora, Mexico

[21] Appl. No.: 211,470

[22] Filed: Nov. 28, 1980

[30] Foreign Application Priority Data

Nov. 29, 1979 [MX] Mexico ..... 180245

[51] Int. Cl.[3] ..... B02C 23/20

[52] U.S. Cl. ..... 241/16; 241/20; 241/21; 209/9; 209/167

[58] Field of Search ..... 209/166, 167, 3, 9; 241/16, 20, 21, 24

[56] References Cited

U.S. PATENT DOCUMENTS

| | | | |
|---|---|---|---|
| 1,509,266 | 9/1924 | Spearman | 209/166 |
| 3,102,856 | 9/1963 | Chase | 209/166 |
| 3,313,412 | 4/1967 | Bloom | 209/167 |
| 3,420,896 | 2/1969 | Baarson | 209/167 |
| 3,811,569 | 5/1974 | Shirley | 209/167 |
| 3,837,489 | 9/1974 | Michalski | 209/167 |
| 3,921,810 | 11/1975 | Hutch | 209/167 |
| 4,199,065 | 4/1980 | Wang | 209/166 |
| 4,229,287 | 10/1980 | Lepetic | 209/107 |

OTHER PUBLICATIONS

Mining Magazine, 1979, pp. 174, 175, 178, 179.

*Primary Examiner*—Robert Halper
*Attorney, Agent, or Firm*—Roylance, Abrams, Berdo & Farley

[57] ABSTRACT

A process for separating molybdenite from copper and iron ores is disclosed. A copper concentrate containing molybdenite is treated during an attritioning stage with a surfactant which is an alkyl ester of sodium and/or calcium succinic or succinamic acids and a molybdenite concentrate is recovered by flotation. The molybdenite concentrate contains at least 90% of the original molybdenite and less than 5% of the undesirable ores.

7 Claims, 1 Drawing Figure

PROCESS FOR SEPARATING COPPER AND IRON MINERALS FROM MOLYBDENITE

BACKGROUND OF THE INVENTION

1. Field of the Invention

This invention relates to the separation of minerals, in particular to a process for the separation of the minerals copper, iron and gangue contained in a concentrate, from the molybdenite contained in the concentrate.

2. Description of the Prior Art

The process of the invention comprises the separation of minerals and gangue which creates an ore, through the process known as flotation. To carry out the separation, chemical substances are used in the system in order to control the behavior of the individual minerals in accordance with the kinetics of flotation.

Ground ore is processed with water to form pulp. The surfaces of the mineral particles are treated with specific chemical reagents that induce hydrophobic or hydrophilic characteristics in the different components of the ore, depending on the properties of such different components.

In a flotation cell, air bubbles are produced, e.g., by agitation of the pulp or by the introduction of pressurized air, and the air bubbles come to the surface. During their ascent they encounter the ore particles in the pulp. Chemical reagents which produce foam may also be added to produce these bubbles and stabilize the foam.

The surfaces of the minerals with hydrophobic characteristics will adhere to the bubbles at the air-liquid interface. In this way, the mineral is carried towards the top of the flotation cell to a level where the pulp overflows in the form of a foam.

Certain of the minerals in the pulp may not be wanted in the process or may not be wanted in this phase of it; and for this reason, chemical reagents must be used to control the recovery sequence of the undesirable minerals. In order to depress the tendency of the unwanted minerals to float, a hydrophilic environment must be established so that the undesirable minerals are wetted and, thus, do not adhere to the air bubbles.

This environment is created by inhibiting adsorption of the collecting reagent and foaming reagent on the surfaces of the undesirable mineral or minerals; that is, by increasing their hydrophilic characteristics. In order to be effective, this phase must be selective accentuating the hydrophobicity of the minerals which it is desired to float, after adding the proper doses of collector reagents.

Recuperation and depression of the minerals is not complete, and there will always be fractions of undesirable minerals mixed with the desirable ones, and vice versa. Avoiding this overlapping of desirable with undesirable minerals contributes, among other factors, to a more economical process of concentration by flotation.

The floating of the minerals by means of foam depends entirely on the surface phenomenon which develops on the facets of the metallic or non-metallic minerals contained in an ore. Only a small surface of the particles is required for the adherence of a substance in the formation of a compound on the facet of the crystal of the mineral. When there are completely cleaned surfaces, the adhesion is complete and the particle floats easily. Interferences with a good adherence are caused by various pulp components, but the most common and the one that affects proper flotation the most is the component of the ore commonly known as ore dust; that is, fine particles usually of less than 70 microns in size.

Separation of the molybdenite from a concentrate of copper minerals involves complicated chemical processes for treating the particles with depressors which inhibit copper floating and improve floating of the molybdenite. The pulp is stirred for a period of 24 to 48 hours, and it is washed with live steam. The processes of concentrate roasting and oxidation are used, together with the decant of fine particles, as well as various combinations of these processes.

The depression of the copper minerals, or the depression of the molybdenite, when applicable, requires conditioning with toxic and dangerous chemicals, as well as the use of inconvenient chemical products. Such materials include arsenic trixoide, phosphorous pentasulfide, sodium cyanide, sodium hydrosulfide, ammonium sulfide, and others. The roasting step, as well as the re-milling of the calcined product, are normally in the intermediate stage of the process.

Many cleaning steps by floating are required in order to produce the desired standard of concentrate; however, value is lost in each step. It is also strictly necessary to supervise the disposal of the residual toxic substances from these complicated processes. This and other factors increase operating costs.

The flotation process may also be conducted in reverse by depressing the molybdenite with the addition of a dextrine solution to the pulp. The copper and iron sulfides are floated and the molybdenite is depressed. In this process, it is necessary to treat the dextrine before trying to thereafter clean the molybdenite by floating.

The minerals which float by themselves, such as talc, sulfur and carbon, are mechanically separated through classification in hydrocyclones, or otherwise with some treatment before the next floating stage.

It is an object of this invention to provide a process for separation by flotation whereby copper, iron and gangue minerals contained in a concentrate are separated from the molybdenite contained in the concentrate, through the use of a system of simple reagents and of reduced toxicity.

Another object of the invention consists in providing a process which achieves excellent depression of undesirable minerals and gangue and a very efficient recuperation of molybdenite.

It is an object of the invention, in contrast to complex prior art systems which use many chemical substances, to provide a process based on a simple system for flotation in which, through the use of appropriate reagents, a maximum depression is obtained, above 90%, of the minerals gangue which are not wanted. Molybdenite particles are produced simultaneously which have a great tendency to float significantly increasing recuperation of the desired mineral.

SUMMARY OF THE INVENTION

The invention provides a process for the separation of copper and iron ores from molybdenite which comprises providing a copper concentrate containing molybdenite and having a solids concentration of between 50% and 60% solids. The concentrate is subjected to attritioning at which time a surfactant, which is an alkyl ester of sodium and/or calciuim sulfosuccinic and/or sulfosuccinamic acids, is added to the concentrate. The concentrate is thereafter treated in a conditioning stage wherein the concentration of solids is reduced to within the range of about 20% to about 25% at a pH of between about 6.0 and 8.5. Other chemical reagents can be added, such as sodium ferrocyanide and/or foaming agents and/or petroleum. Thereupon the pulp, thus obtained, is passed through a bank of flotation cells wherein a concentrate of molybdenite is recovered by floating. The concentrate of molybdenite obtained from the cells is subjected to further cleaning stages in flotation cells until a final concentrate containing more than 90% of the original molybdenite is recovered by flotation. The wastes from the flotation cells contain a copper concentrate and comprise more than 95% of the undesirable ores.

Preferably, the surfactant added during the attritioning stage is added in an amount of up to about 0.300 Kg. per ton of ore treated. In another preferred aspect of the invention, after all cleaning stages, the final molybdenite concentrate obtained has a molybdenite concentration of at least 51%

BRIEF DESCRIPTION OF THE DRAWING

In the drawing which forms part of the original disclosure of the invention.

DETAILED DESCRIPTION OF THE PREFERRED EMBODIMENTS

Figure 1:
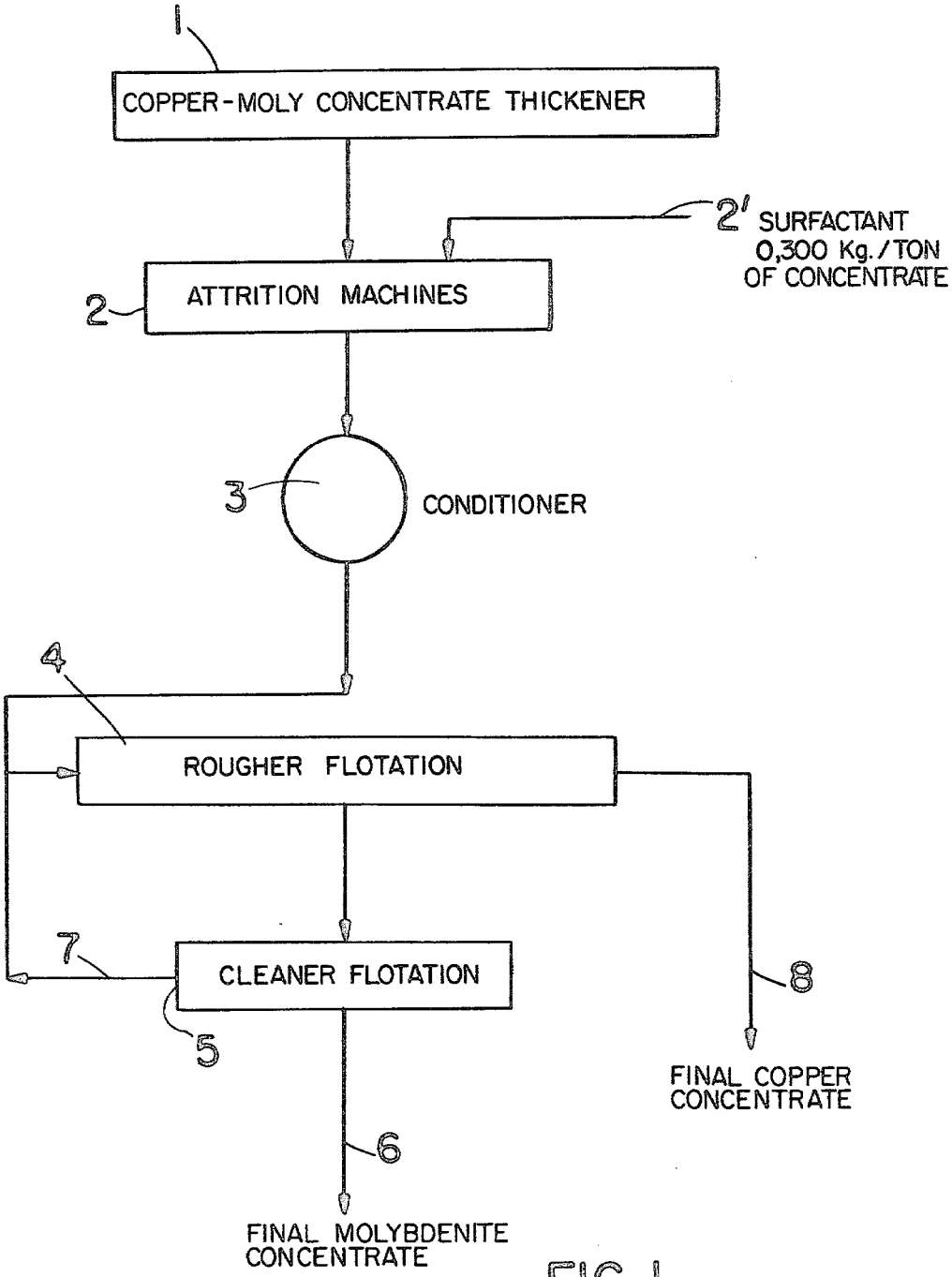
FIG. 1 is a diagrammatic illustration of an advantageous embodiment of the process of the invention.

The invention is based fundamentally on a process which uses a system of chemical reagents with surfactant or surface active properties. The chemical reagents are alkylic esters from sodium or calcium sulfosuccinic acids or sodium or calcium succinamic acids. The esters are derived from the acids and have in that portion of the molecule, which corresponds to the alcohol, two alkyl groups of from 6 to 12 atoms of carbon and preferably 8 atoms of carbon.

These surfactants are well known to those skilled in the art and are disclosed in, for example, U.S. Pat. No. 2,028,091 to Jeager and U.S. Pat. No. 2,252,401 to Jeager. The disclosure of these patents is hereby incorporated by reference.

Tetrasodium N-(1,2dicarboxyethyl)-N-octadecyl sulfosuccinamate has been used in flotation processes, particularly in the concentration of oxidized minerals and also for the non-metallic minerals such as cassiterite, barite and, up to a certain point, fluorite. Sodium dioctyl sulfosuccinamate has found limited use in the filtration of concentrates. The surface active properties reduce the surface tension of the bubbles contained in the pulp. This reduces the resistance of the water to flowing, thus producing a drier product.

The mechanism through which the surfactant reagent, as used in the present invention, i.e, for the separation of copper minerals from molybdenite and which makes all of the unwanted minerals of the concentrate hydrophilic, is believed to be as discussed in the following paragraph.

A surface active reagent is a substance which, in a chemical process, alters the potential energy on the surfaces and interfaces. The interfacial phenomenon is part of the flotation process, and it is for this reason that surfactants intervene in a very important way. They are absorbed on the mineral surface and the liquid interface in such a way that the behavior of the mineral before and after adhesion is completely altered and, therefore, the mineral responds in a different manner. Both the hydrophobic and hydrophilic groups are included in the same system. In the flotation process of this invention, the moistening or wetting phenomenon acts to give hydrophilic characteristics to the surfaces of minerals such as chalcocite, chalcopyrite, quartz, carbon, mica, etc., while the naturally hydrophobic surface, as is that of the molybdenite particles, does not suffer any alteration in the least.

The dispersing properties of the surfactants permit them to be absorbed on the mineral surfaces, resulting in a sufficient increase in the potential charge so that the particles repel one another in aqueous media. A surfactant must be a humectant and also must be ionic by nature. The surface active ions are absorbed on the unaltered surface of a nonpolar mineral, as on molybdenite and carbon, causing an accumulation of charges of equal polarity on the particles. This electrical accumulation promotes repellancy among them, resulting in a magnificent dispersion which occurs on the non-contaminated surfaces, which respond promptly to the flotation promoters.

The process of this invention for the separation of copper and iron minerals from molybdenite is better illustrated with reference to the diagramatic illustration of an embodiment of the process shown in FIG. 1. A pulp concentrate of copper which contains molybdenite 1 passes a series of attrition mills, 2 where a set amount of surfactant 2' is added. During attritioning, it is desirable to have the heaviest pulp possible, approximately 55% solids, i.e., 50 to 60% solids. After about 30 minutes of attritioning, the pulp is diluted in conditioner No. 3 until it reaches approximately 20% solids. A conventional foaming agent can be added here, as well as petroleum and sodium ferrocyanide. Conventional foaming or frothing agents are well known to those skilled in the art and include pine oils, terpineols, cresote, cresylic acid, alcohols, ethoxylated alcohols of 5 to 8 carbon atoms, ethers, propylene glycols and the like. After approximately 2 minutes, this pulp passes through a bank of primary flotation cells 4, where a supply of primary concentrate is recovered. This concentrate passes through a first cleaning stage 5, where a small amount of sodium ferrocyanide is added and, then passes successively through additional cleaning stages until completing up to 6 successive cleanings, obtaining approximately 55% final molybdenite concentrate. The tailings from the cleaning steps, 7, return to the primary flotation cell closing the cycle and the tailing 8, from primary flotation, are the final concentrates of copper and iron ores.

The following examples serve to illustrate the practice of the present invention.

EXAMPLE I

In accordance with the stages of the process for separating copper and iron ores from molybdenite described above, a copper concentrate was fed through attrition machines wherein about 0.250 Kg./ton of a surfactant comprising a base of alkyl esters of sodium sulfosuccinic and sulfosuccinamic acids was added to a 55% concentration of solids. Following attritioning, the pulp was passed through a conditioner wherein the concentration of solids was reduced to 22% at a pH of 6.6 and 0.0075 Kg./ton of a conventional foaming agent and 1.565 Kg./ton of $Fe(CN)_6Na_4$ were added. The primary concentrate was freed of slimes and 0.390 Kg./ton of $Fe(CN)_6Na_4$ was added at the head of the first cleaning stage. In Table I below, the results obtained from the invention's process are shown.

TABLE I

| PRODUCT. | WEIGHT. % | ASSAYS Cu | Mo | Fe | DISTRIBUTION Cu | Mo | Fe |
|---|---|---|---|---|---|---|---|
| Head | 100.000 | 33.605 | 0.0961 | 22.582 | 100.000 | 100.000 | 100.000 |
| 1st Cleaning Concentrate | 0.366 | 19.30 | 24.28 | 16.40 | 0.211 | 92.508 | 0.266 |
| 1st Cleaning Concentrate-Slimes | 4.174 | 34.900 | 0.072 | 25.00 | 4.336 | 3.122 | 4.623 |
| Rougher Concentrate. | 0.187 | 34.70 | 0.240 | 22.00 | 0.193 | 0.416 | 0.186 |
| Rougher tailing | 95.273 | 33.60 | 0.004 | 22.50 | 95.260 | 3.954 | 94.925 |
| | | | | | 100.00 | 100.000 | 100.00 |

From the foregoing, the following can be observed. A pulp with 55% solids was put through attritioning with 250 gms. of surfactant/ton. The pulp was conditioned to 22% solids with pH adjusted to 6.6 and the following materials were added:

0.0075 Kg./ton of foaming agent CC-1065 (commercially available from Productos Quimicos Parala Mineria, SA Mexico 14, D.F., Mexico)

1.565 Kg./ton of $Fe(CN)_6Na_4$.

The primary concentrate was freed of mud. Thereafter, 0.390 Kg./ton of $Fe(CN)_6Na_4$ was measured into the first cleaning using the surfactant for floating molybdenite. It is clearly seen that it is possible to depress the undesirable minerals more than 95% and at the same time float more than 90% of the molybdenite when sufficient surfactant reagent is used to wet the undesirable minerals. In Table I, it is shown that by feeding 250 gms. per ton of surfactant reagent to the attrition machines, the undesirable ores do not float, the copper being depressed in a percentage of 95.26 of its content, and 94.925% of the iron being depressed, while 94% of the molybdenite, the desirable ore, floats. The pH of the pulp was adjusted to 6.6 with the addition of sulphuric acid. Sodium ferrocyanide was added in an amount of 1.565 kilos to the primary floating to help to depress the copper sulfide ore dust. A molybdenite concentrate was obtained in the first cleaning with a concentration of 24.28% Mo and a 92.508% recovery of the molybdenite contained in the sample.

EXAMPLE II

Following the stages of the process as previously described, the copper concentrate was fed to the attrition machines wherein the surfactant of Example I was added in an amount of 0.226 Kg./ton. The copper concentrate had a solids content of 55%. The resultant pulp was passed to a conditioner where the concentration of solids was reduced to 20%, the pH was adjusted to 6.5 and the following materials were added:

0.0112 Kg./ton of petroleum, 0.0176 Kg./ton of foaming agent, and 0.642 Kg./ton of $Fe(CN)_6Na_4$.

The primary concentrate was not freed of slimes; in the first cleaning stage 0.630 Kg./ton of $Fe(CN)_6Na_4$ was added to the concentrate. The results obtained are shown in Table II.

TABLE II

| PRODUCT. | WEIGHT % | ASSAYS. Cu | Mo | Fe | DISTRIBUTION. Cu | Mo | Fe |
|---|---|---|---|---|---|---|---|
| Head | 100.000 | 26.27 | 0.141 | 26.000 | 100.000 | 100.00 | 100.000 |
| First Cleaner Concentrate | 0.352 | 9.20 | 38.490 | 6.60 | 0.122 | 96.236 | 0.088 |
| 1st Cleaning Tailings | 0.860 | 29.30 | 0.150 | 22.40 | 0.959 | 0.923 | 0.742 |
| Rougher Tailings | 98.788 | 26.30 | 0.004 | 26.10 | 98.919 | 2.841 | 99.170 |
| | | | | | 100.000 | 100.000 | 100.000 |

The results shown in Table II demonstrate that the surfactant is as effective or more so when the primary concentrate is not freed of slimes. The attritioning, conditioning and floating time were the same as those of Example I. A small amount of petroleum was added in the conditioner to improve floating of the molybdenite. The depression of the undesirable minerals was considerably better, and the recovery of the desirable molybdenite ore greater.

EXAMPLE III

Following the stages of the process as previously described, a copper concentrate was fed to attrition machines wherein 0.289 Kg./ton of the surfactant of Example I was added to a 55% solids concentrate. The pulp was passed to a conditioner wherein the solids content was adjusted to 22%, the pH was adjusted to 8.5 and the following reagents were added:

0.0143 Kg./ton of petroleum, 0.0225 Kg./ton of foaming agent, and 0.885 Kg./ton of $Fe(CN)_6Na_4$.

The primary concentrate was not freed of slimes. In the first cleaning stage, $Fe(CN)_6Na_4$ was added at a dosage rate of 0.630 Kg./ton. The results obtained are shown in Table III.

TABLE III

| PRODUCT. | Weight % | Assays | | | DISTRIBUTION. | | |
|---|---|---|---|---|---|---|---|
| Head. | 100.000 | 27.067 | 0.130 | 22.792 | 100.000 | 100.00 | 100.00 |
| 1st Cleaning Concentrate | 0.338 | 9.50 | 36.580 | 5.30 | 0.118 | 95.004 | 0.079 |
| 1st Cleaning Tailings | 0.624 | 31.45 | 0.040 | 15.10 | 0.727 | 1.922 | 0.412 |

TABLE III-continued

| PRODUCT. | Weight % | Assays | | | DISTRIBUTION. | | |
|---|---|---|---|---|---|---|---|
| Rougher Tailings | 99.038 | 27.10 | 0.004 | 22.90 | 99.155 | 3.074 | 99.509 |
| | | | | | 100.000 | 100.000 | 100.000 |

In this example, flotation was carried out at a pH of 8.5 instead of 6.6 and 6.5 as in the two previous examples. The other reagents were the same. The results obtained were practically the same, a fact which demonstrates that pH range is quite wide for production of satisfactory results.

EXAMPLE IV

Following the stages of the process as previously described, a copper concentrate was fed to attrition machines wherein the surfactant of Example 1 was added to a 55% solids concentrate at a dosage rate of 0.183 Kg./ton. The pulp was passed to the conditioner wherein the concentration of solids was reduced to 25%, the pH was adjusted to 6.0 and the following reagents were added:

0.0138 Kg./ton of petroleum, and 0.0071 Kg./ton of foaming agent.

The primary concentrate was freed of slimes. In the first cleaning stage was added 0.208 Kg./ton of CaO at a pH of 9.8. To the second cleaning, 0.010 Kg./ton of the surfactant of Example I was added. The results obtained are shown in Table IV.

TABLE IV

| PRODUCT. | WEIGHT | ASSAYS | | | DISTRIBUTION | | |
|---|---|---|---|---|---|---|---|
| Head | 100.000 | 32.885 | 0.123 | 10.910 | 100.000 | 100.000 | 100.000 |
| 2nd Cleaning Concentrate | 0.197 | 3.60 | 51.70 | 1.30 | 0.021 | 82.899 | 0.015 |
| 2nd Cleaning Tailings | 0.051 | 28.20 | 6.00 | 7.70 | 0.043 | 2.524 | 0.020 |
| 1st cleaning Tailings | 0.445 | 28.70 | 0.60 | 17.90 | 0.387 | 2.199 | 0.402 |
| Slimes | 0.297 | 38.10 | 1.10 | 7.20 | 0.344 | 2.687 | 0.105 |
| Primary Concentrate | | | | | | | |
| Tailings Rougher Flotation | 99.010 | 32.95 | 0.012 | 20.00 | 99.205 | 9.691 | 99.458 |
| | | | | | 100.000 | 100.000 | 100.000 |

The tests shown in Example IV was carried to the second cleaning without the use of sodium ferrocyanide. The depression of undesirable minerals was highly satisfactory; however, recovery of molybdenite was low due to the smaller amount of surfactant used during attritioning of the pulp; that is, only 183 gms. of surfactant were added per ton. Furthermore, it is shown that the use of sodium ferrocyanide is not entirely necessary in order to produce a molybdenite concentrate of a high standard, together with acceptable recovery of the ore through the use of the surfactants used in this invention; that is, the alkyl esters of sodium sulfosuccinic and sodium sulfosuccinamic acids in the flotation of molybdenite. It is clearly seen that more than 95% of the undesirable ores can be depressed while floating more than 90% of the molybdenite when a sufficient amount of reagent is used.

While the invention has been described in considerable detail with particular reference to advantageous embodiments thereof, variations and modifications can be made without departing from the scope of the invention as disclosed in the specification and defined in the appended claims.

What is claimed is:

1. A process for the separation of copper and iron ores from molybdenite which comprises:

providing a copper concentrate containing molybdenite and iron ore in an attritioning stage at a concentration of between about 50 and about 60% solids;

adding to the concentrate in the attritioning stage a surfactant comprising alkyl esters of sodium and/or calcium sulfosuccinic or sulfosuccinamic acids;

passing the resultant pulp to a conditioning stage wherein the concentration of solids is reduced to between about 20 to 25% at a pH value of between about 6.0 and 8.5;

passing the resultant material to a bank of flotation cells and recovering a concentrate of molybdenite by floatation;

treating the molybdenite concentrate in at least one cleaning stage; and recovering a final molybdenite concentrate which contains more than 90% of the original molybdenite and less than 5% of the undesirable ores.

2. The process of claim 1, wherein during the attritioning stage there is added the surfactant in an amount of up to about 0.300 Kg./ton of copper concentrate.

3. The process of claim 2, wherein during the conditioning stage there are added at least one compound of the group consisting of sodium ferrocyanide, foaming agents and petroleum.

4. The process of claim 2, wherein the alkyl portions of the esters of sodium and/or calcium sulfosuccinic and sulfosuccinamic acids have from 6 to 12 atoms of carbon.

5. The process of claim 4, wherein the alkyl portions have 8 carbon atoms.

6. The process of claim 1, wherein during the cleaning stages there is added sodium ferrocyanide to recover the final concentrate of molybdenite having a grade of at least 51.0% molybdenum.

7. The process of claim 1, wherein the molybdenite concentrate recovered from the first flotation stage can be subjected to a desliming operation.

* * * * *